US011719076B2

(12) United States Patent
McChesney et al.

(10) Patent No.: US 11,719,076 B2
(45) Date of Patent: Aug. 8, 2023

(54) HYDRAULIC SCREEN HAVING A JOINT WITH A FLOW PATH

(71) Applicant: Halliburton Energy Services, Inc., Houston, TX (US)

(72) Inventors: Ryan Wesley McChesney, Prosper, TX (US); Gordon McLeary, Dallas, TX (US); David Symon Grant, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/945,689

(22) Filed: Jul. 31, 2020

(65) Prior Publication Data

US 2022/0034201 A1 Feb. 3, 2022

(51) Int. Cl.
*E21B 43/08* (2006.01)

(52) U.S. Cl.
CPC ..... *E21B 43/08* (2013.01)

(58) Field of Classification Search
CPC ..... E21B 43/08–108
See application file for complete search history.

(56) References Cited

U.S. PATENT DOCUMENTS

| | | | | |
|---|---|---|---|---|
| 5,868,200 | A * | 2/1999 | Bryant | E21B 43/08 166/51 |
| 6,405,800 | B1 | 6/2002 | Walker et al. | |
| 7,938,184 | B2 * | 5/2011 | Yeh | E21B 43/04 166/278 |
| 8,479,810 | B2 | 7/2013 | Metcalfe | |
| 9,677,387 | B2 * | 6/2017 | Yhuel | E21B 43/088 |
| 10,975,660 | B2 * | 4/2021 | Bruce | E21B 43/108 |
| 2004/0163804 | A1 | 8/2004 | Bode | |
| 2006/0060352 | A1 * | 3/2006 | Vidrine | E21B 43/045 166/276 |

(Continued)

FOREIGN PATENT DOCUMENTS

| | | |
|---|---|---|
| GB | 2492193 A | 6/2013 |
| GB | 2500109 A | 10/2013 |
| GB | 2500110 B | 2/2014 |

OTHER PUBLICATIONS

International Search Report and Written Opinion issued in corresponding International PCT Patent Application No. PCT/US2020/045793; dated Mar. 18, 2021.

*Primary Examiner* — Steven A MacDonald
(74) *Attorney, Agent, or Firm* — Barnes & Thornburg, LLP

(57) ABSTRACT

An apparatus for activating chambers of downhole hydraulic screens. The apparatus comprises an outer sleeve, an inner sleeve, and a flow path. The outer sleeve is coupled to one hydraulic screen on one end and another hydraulic screen on another end. The inner sleeve couples to base pipe at both ends. The flow path is an annulus defined between the outer diameter of the inner sleeve and the inner diameter of the outer sleeve. Hydraulic seals are formed at the interfaces between the inner sleeve and base pipe and the outer sleeve and hydraulic screens. In practice, the assembled apparatus and hydraulic screens are ran downhole to a production zone using production tubing and a running tool. Fluid from the surface is pumped into the production tubing, diverted therefrom, and into chambers of the hydraulic screens using the flow path to conduct fluid between the hydraulic screens.

20 Claims, 3 Drawing Sheets

(56) References Cited

U.S. PATENT DOCUMENTS

| | | | | |
|---|---|---|---|---|
| 2009/0095471 | A1* | 4/2009 | Guignard | E21B 43/04 166/278 |
| 2010/0096120 | A1* | 4/2010 | Ayasse | E21B 43/08 166/55.1 |
| 2013/0220606 | A1* | 8/2013 | Yhuel | E21B 43/04 166/278 |
| 2014/0262322 | A1* | 9/2014 | Yeh | E21B 43/08 166/373 |
| 2014/0299310 | A1 | 10/2014 | Cunningham | |
| 2015/0027726 | A1* | 1/2015 | Bruce | E21B 43/086 166/373 |
| 2016/0326849 | A1* | 11/2016 | Bruce | E21B 43/084 |
| 2018/0266219 | A1* | 9/2018 | Coffin | E21B 43/088 |

* cited by examiner

HYDRAULIC SCREEN HAVING A JOINT WITH A FLOW PATH

BACKGROUND

The production of hydrocarbon reservoirs from mature and deep wells require some form of downhole sand control. Sand production in a well can slow production and damage equipment. An effective technology currently in use is Endurance Hydraulic Screen (EHS) technology developed and provided by Halliburton. Hydraulic screens offer several advantages over traditional sand control technologies, such as mechanically activatable screens and gravel packing, which are more complex in terms of installation and use, time consuming in terms of man power, and, therefore, more expensive solutions. In the case of hydraulic screens, the screens are ran to a setting depth, which is the production zone or zones, using a running tool and activated by applying a surface applied pressure to the screens. During activation, fluid pumped into a screen and into chambers of the screen causes the screen to increase in diameter. Activation of the chambers functions to close the annular gap between the screen and the formation walls of a production zone. Stated differently, activated screens sweep and pack an annular gap in the production zone of the well and, therefore, stabilizes the production zone. This stabilization prevents fines migration and plugging. Once a zone has been stabilized, the applied pressure can be bled off and hydrocarbons can be pumped from a formation to the surface for refinement and distribution.

The hydraulic screen comprises a valve module, an outer shroud that is an expandable skin made of a metal mesh, sand filtration media, a drainage support layer, chambers, and base pipe. The valve module is a mechanical apparatus, such as a sleeve, that can be manipulated so as to provide a flow path for fluid pumped from the surface through an internal diameter of the running tool and into the chambers of the hydraulic screen. The valve module can also be manipulated so as to provide a flow path for hydrocarbons from the production zone, through the metal mesh, and into production tubing. Additionally, the valve module introduces moveable parts into a system of screens that can result in reliability issues and an increase in cost of manufacturing the screens.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
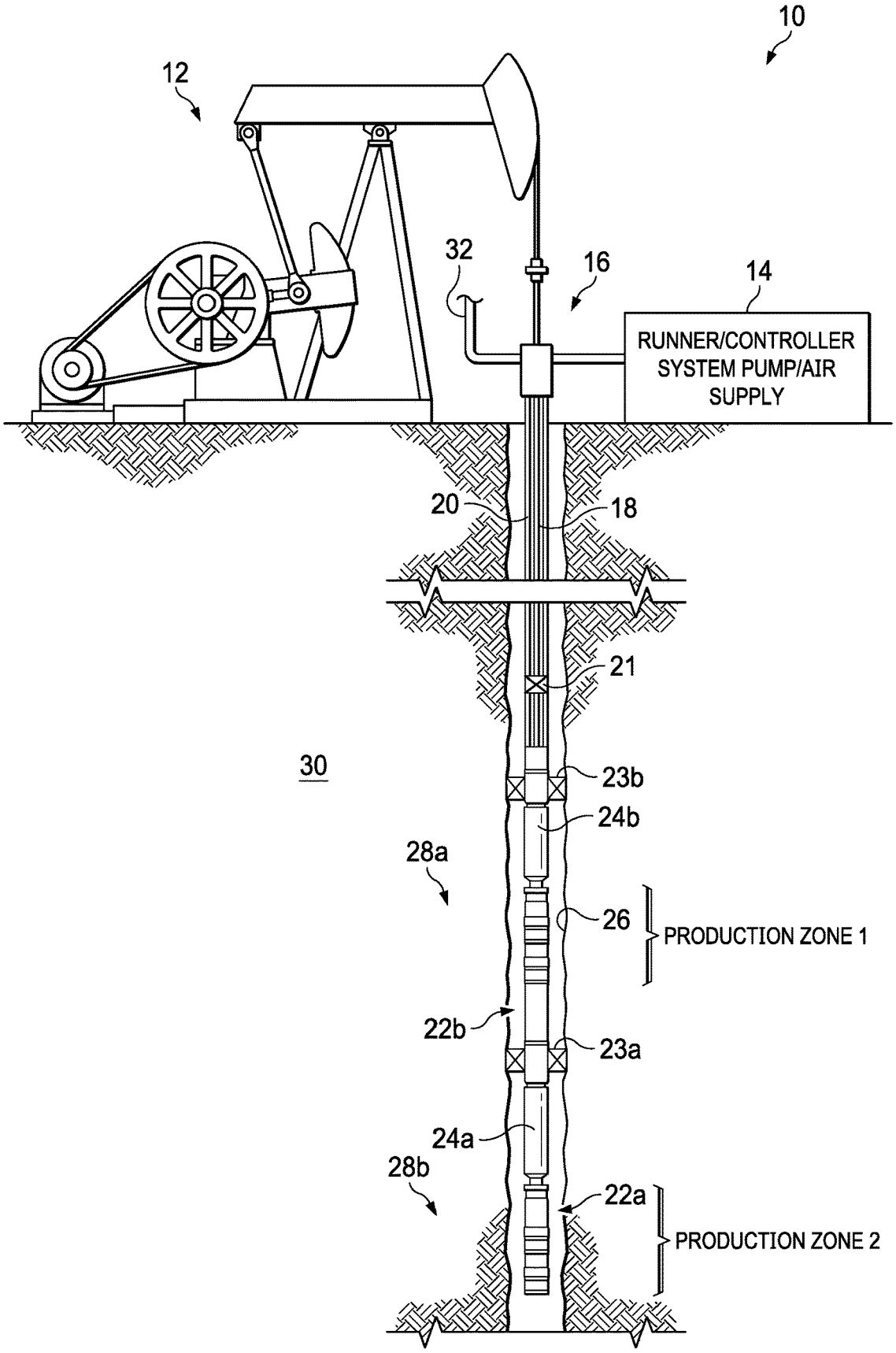
FIG. 1 is an illustration of a diagram for a well site operation for activating chambers of downhole hydraulic screens, in accordance with certain example embodiments.

While various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

Presented herein is a joint for coupling hydraulic screens together and used to communicate fluid between hydraulic screens and into a chamber or chambers of the hydraulic screens. The joint comprises an inner sleeve and an outer sleeve and a flow path. The flow path is used to channel fluid from a source into a hydraulic screen. The source itself can be a hydraulic screen. The flow path is an annulus of the joint. The annulus is defined by an outer diameter of the inner sleeve and an inner diameter of the outer sleeve. The inner sleeve is configured to couple with production tubing using, for example, a threaded interface. A hydraulic seal can be formed about the threaded interface using a gasket, either metal, non-metal, a composite, or combination thereof. The outer sleeve is configured to form a hydraulic seal with a hydraulic screen using a threaded interface, gaskets, either metal, non-metal, a composite, or combination thereof. Although the interfaces between the inner sleeves, base pipes, outer sleeves, and hydraulic screens can be a welded interface or lock and retain means, or any combination thereof. In addition, the joint can comprise a diverter. The diverter may be used to couple a screen to the flow path. The interface between the diverter, the screen, and the outer sleeve can also a threaded interface, a welded interface, or a locking mechanism with a hydraulic seal.

Presented herein is a hydraulic screen comprising a joint, chambers, and a screen. The joint is used to communicate fluid between hydraulic screens and into a chamber or chambers of the hydraulic screens. The joint comprises an inner sleeve and an outer sleeve and a flow path. The flow path is used to channel fluid from a source into a hydraulic screen. The source itself can be a hydraulic screen. In an embodiment, the flow path is an annulus of the joint. Although, the flow path can be tubing used to conduct fluid between hydraulic screens. The annulus is defined by an outer diameter of the inner sleeve and an inner diameter of the outer sleeve. The inner sleeve is configured to couple with production tubing using, for example, a threaded interface and form a hydraulic seal using gaskets, either metal, non-metal, a composite, or combination thereof. The outer sleeve is configured to form a hydraulic seal with a hydraulic screen using a threaded interface and a gasket, either metal, non-metal, a composite, or combination thereof. Although the interfaces between the inner sleeves, base pipes, outer sleeves, and hydraulic screens can be a welded interface or lock and retain means, or any combination thereof. In addition, the joint can comprise a diverter. The diverter may be used to couple a screen to the flow path. The interface between the diverter, the screen, and the outer sleeve can also a threaded interface, a welded interface, or a locking mechanism with a hydraulic seal.

Presented herein is a method for activating chambers of downhole hydraulic screens. The method includes coupling a plurality of inner sleeves and base pipe together and coupling a plurality of outer sleeves and downhole hydraulic screens together. The method further includes running the base pipe into a subterranean well to a production zone and pumping fluid into the base pipe, into flow paths defined between the inner sleeves and the outer sleeves, and into the chambers of the hydraulic screens. In one embodiment, the method can include coupling an activation module to the base pipe, the plurality of inner sleeves to the base pipe, the plurality of outer sleeves to downhole hydraulic screens, and running the base pipe into a subterranean well. In this embodiment, the method further includes activating the activation module and then pumping fluid into the base pipe, into the flow paths, and into the chambers of the hydraulic screens. Activating the chambers of the hydraulic screens results in stabilization of the production zone. The method can also include releasing the fluid pumped into the base pipe and producing or pumping hydrocarbons from a reservoir in an earth formation through the hydraulic screen and into the internal diameter of each inner sleeve.

Referring now to FIG. 1, illustrated is a diagram of a well site operation for activating chambers of downhole hydraulic screens, according to certain example embodiments, denoted generally as 10. The well site operation 10 comprises a pump jack 12, a controller 14, a polished rod, stuffing box, and tee assembly 16, production tubing 18, which is also referred to as base pipe, completion tubing 20, activation module 21, a series of coupled joints and hydraulic screens 22*a*, 22*b*, packers 23*a*, 23*b*, pump and injector systems 24*a*, 24*b*, and wellbore 26, and production zones for accessing hydrocarbons in an earth formation 30. Although the well site operation 10 depicts a land based well, the operation site 10 can also be any type of well site where sand control in the earth formation 30 is required for the production of a hydrocarbon reservoir. The hydraulic screen 22*a* and 22*b* can be commercially available hydraulic screens, e.g. Halliburton Endurance Hydraulic Screen®.

Completion tubing 20 can be liner hanger and casing or any type of equipment that functions to secure the series of coupled joints and hydraulic screens 22*a*, 22*b*, packers 23*a*, 23*b*, and pump and injector systems 24*a*, 24*b* to a running string of the controller 14. Production tubing 18 is also secured to the running string. Production tubing 18 is also present in the joints and hydraulic screens 22*a*, 22*b*. However, in the case of the joints, production tubing is referred to as an inner sleeve. The controller 14 can run the production tubing 18 and completion tubing 20 to a production zone. Once at the desired depth, the string can be released and the production tubing 18 and completion tubing 20 secured to the tee assembly 16 so that the hydraulic screens can be used to support the wellbore in the production zone and, finally, so that reservoir production can begin.

The controller 14 can activate the activation module 21. The activation module 21, in essence, is a valve that can divert fluid from the production tubing 18 into an annulus defined between the outer diameter of the production tubing 18 and the inner diameter of the completion tubing 20. Once activated, fluid can be pumped to the series of coupled joints and hydraulic screens 22*a*, 22*b*. The pump and injector systems 24*a*, 24*b* are coupled to the pump jack 12 through the production tubing 18. The production tubing 18 runs down the center of the completion tubing 20 and the series of coupled joints and hydraulic screens 22. The pump jack 12 and pump and injector systems 24*a*, 24*b*, in essence, can create pressure in the production tubing 18 for the purpose of pushing fluid into chambers of the hydraulic screens 22*a*, 22*b*. The pump jack 12 24*a*, 24*b* can work together to pull hydrocarbons from a reservoir in the earth formation 30.

The hydraulic screens comprise inlets, outlets, an outer shroud (not illustrated) that is an expandable skin made of a metal mesh, sand filtration media (not illustrated), a drainage support layer (not illustrated), base pipe 18, and at least one chamber. The chambers of the hydraulic screens are activated before the production of a hydrocarbon reservoir in order to remove an annular gap in the wellbore 26 of a production zone. The chambers activate radially in response to an application of a pressurized flow. The series of coupled joints and hydraulic screens 22 and a pump and injector system 24 can be ran downhole to a setting depth using the controller system 14, completion tubing 20, and the running string. The activation module 21 is then manipulated. A pressurized fluid can be pumped through the production tubing 18 and through the completion tubing 20 and into the chambers of the downhole hydraulic screens. Activation of the chambers removes the annular gap in the wellbore 26 of the production zones in the earth formation 30. Once the wellbore 26 is stabilized, the downhole pressure can be bled off. However, pressure in the chambers of the hydraulic screens 22*a*, 22*b* is maintained. At this point, hydrocarbons can be pulled from the earth formation 30 using the pump and injector systems 24*a*, 24*b*, the production tubing 18, and the pump jack 12.

Figure 2:
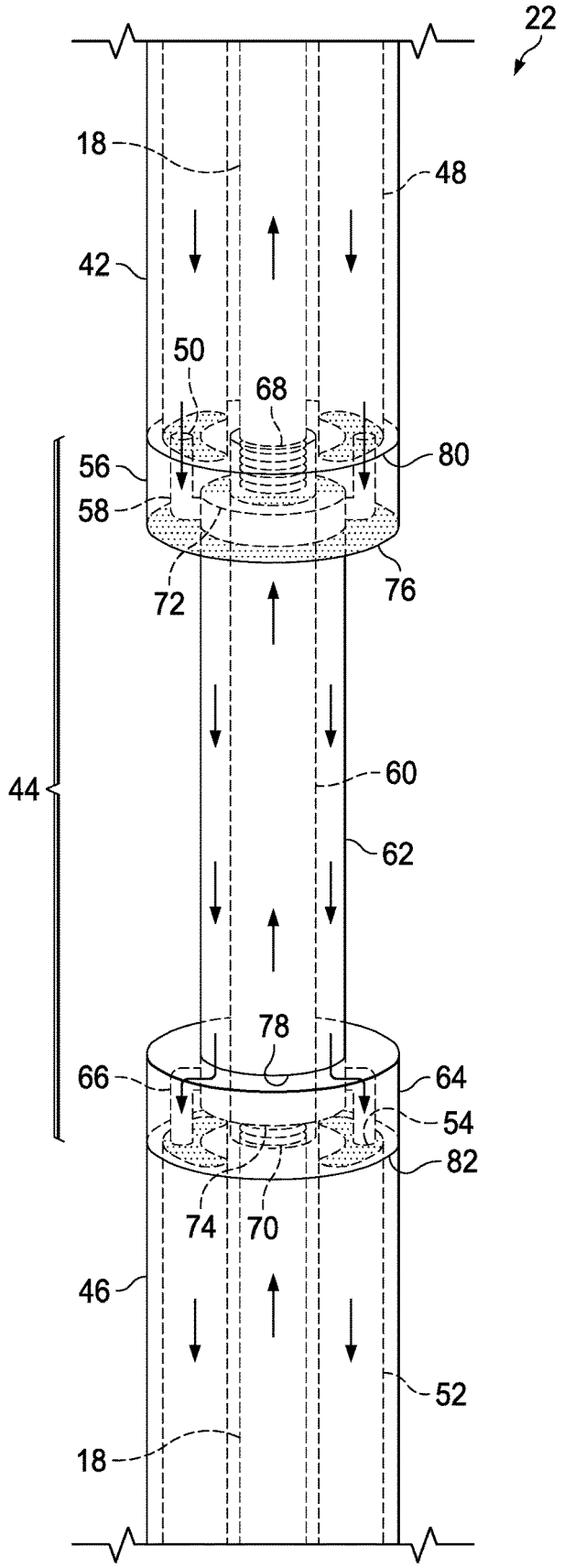
FIG. 2 is an illustration of an isometric view of a section of the series of coupled joints and hydraulic screens, in accordance with certain example embodiments.

Referring now to FIG. 2, illustrated is an isometric view of a section of the series of coupled joints and hydraulic screens 22, according to certain example embodiments. The section comprises a hydraulic screen 42, joint 44, and another hydraulic screen 46. The hydraulic screen 42 comprises chamber inlet or inlets (not illustrated), chambers 48, chamber outlet or outlets 50, and an outer skin made of metal mesh (not illustrated). The base pipe 18 runs down the center of the hydraulic screen 42. The base pipe 18 comprises ports (not illustrated) for providing a flow path between the metal mesh and an internal diameter of the base pipe 18. The other hydraulic screen 46 also comprises chambers 52, chamber inlet or inlets 54, chamber outlet or outlets (not illustrated), and an outer skin made of metal mesh (not illustrated). Base pipe 18 also runs down the center of the hydraulic screen 46.

The joint 44 comprises a diverter 56, diverter inlet port or ports 58 (depending on the number of chambers), an inner sleeve 60, an outer sleeve 62, diverter 64, and diverter outlet port or ports 66 (depending on the number of chambers), and a flow path. The outlets 50 of the hydraulic screen 42 are coupled to the diverter inlet ports 58. The inlets 54 of the other hydraulic screen 46 are coupled to the diverter outlet ports 66. The flow path is an annulus defined between an outer diameter of the inner sleeve 60 and an inner diameter of the outer sleeve 62 that extends from the diverter inlet ports 58 to the diverter outlet ports 66. The base pipe 18 and inner sleeve 60 can be coupled together at interfaces 68, 70. The outer sleeve 62 can be coupled with the inner sleeve 60 at interfaces 72, 74 and the diverters 56, 58 at interfaces 76, 78. The diverters 56, 58 can be coupled with hydraulic screens 42, 46 at interfaces 80 and 82. A hydraulic seal can be formed at any of the interfaces using a gasket, either metal, non-metal, a composite, or combination thereof. Any of the coupled interfaces can be a threaded interface, a welded interface, or otherwise locked in place.

Although not illustrated, the hydraulic screens 42, 46 include an outer skin made of a metal mesh for filtering sand and a shroud surrounding the outer skin to protect the hydraulic screen when running down hole. The chambers 48, 52 are internal to the metal mesh and shroud. The hydraulics screens 42, 46 can include ports that in conjunction with the metal mesh allows fluid to be pumped into and out of an inner diameter of the base pipe 18. It should also be understood that there may be only one chamber in a hydraulic screen or a plurality. The number of chamber inlets 54, chamber outlets 50, and diverter ports 56, 58 may be dependent on the number of chambers in a hydraulic screen or it may be independent. It should also be understood that the chamber inlets 54 and outlets 50 may be physically coupled to the diverter ports 58, 66. It should also be understood that that there may be one diverter port 58 that couples with multiple chamber outlets 50. The same can be said for screen 46 and diverter 64. It should also be understood that the joint may be a single machined piece or the diverters 56, 64 and the outer sleeve 62 may be a single machined piece or the inner sleeve 60 and the outer sleeve 62 may be a single machined piece. It should also be understood that the shape and size of the inlets, outlets, and ports may vary depending on the design of hydraulic screen and its chambers. In addition, in some embodiments, the inner sleeve 56 may comprise an upper section and a lower section that can be coupled together using a threaded or push fit interface with a hydraulic seal formed there between using a gasket, such as metal, non-metal, or a composite.

Figure 3:
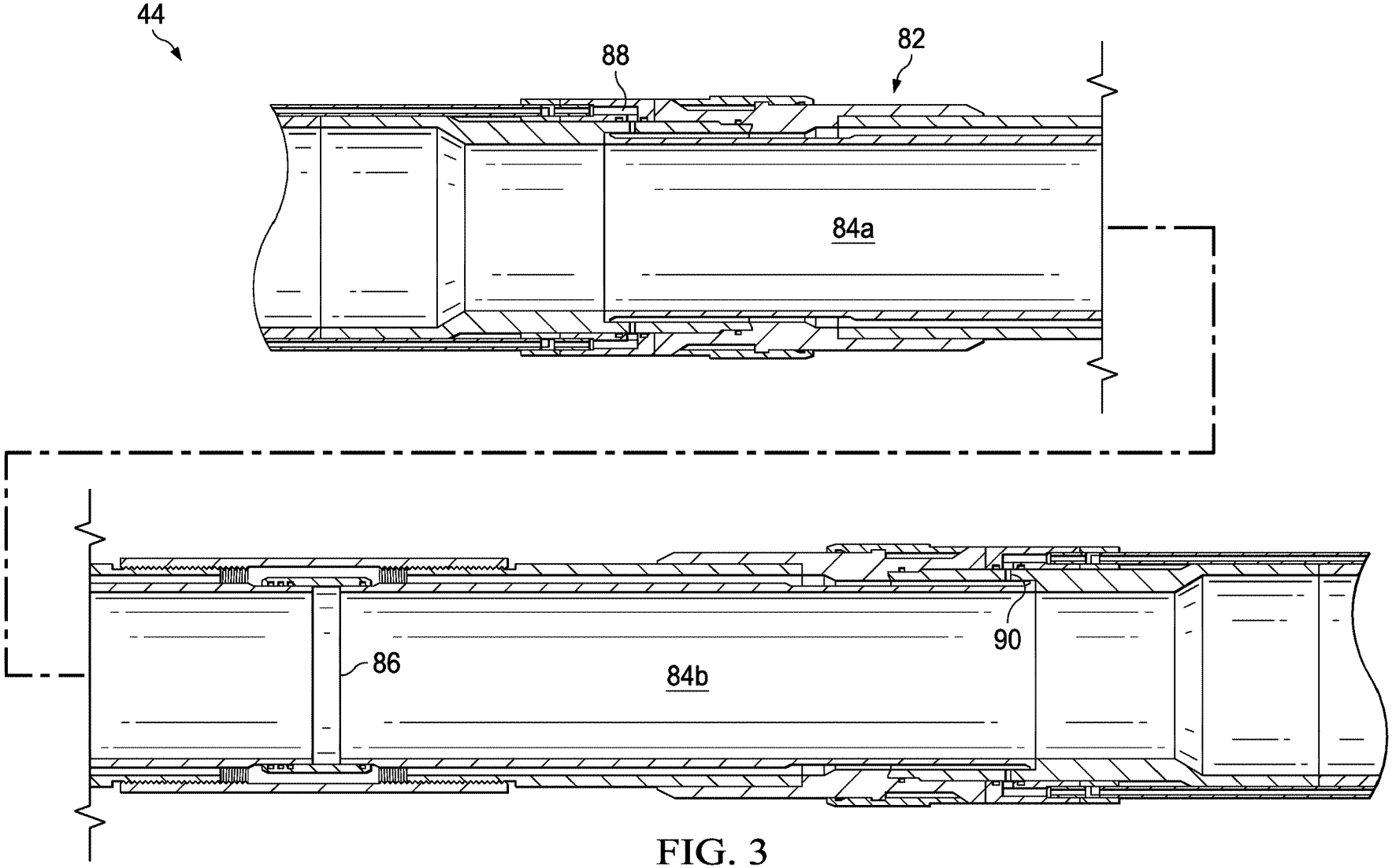
FIG. 3 is a cross sectional view of the joint, in accordance with certain example embodiments.

Referring now to FIG. 3, illustrated is a cross sectional view of the joint 44, according to certain example embodiments. The joint 44 comprises an outer sleeve 82, an upper inner sleeve 84*a*, a lower inner sleeve 84*b*, hydraulic seal 86 formed there between when the lower and inner sleeves 84*a*, 84*b* are coupled together, diverter inlet 88, and diverter outlet 90. The hydraulic seal 86 can be formed using threaded interfaces and/or gaskets, either metal, non-metal, a composite, or combination thereof, to form a hydraulic seal. Fluid can travel through the diverter inlet 88 from a hydraulic screen, through an annulus defined between the inner sleeves 84*a*, 84*b* and the outer sleeve 82, and through the diverter outlet 90 to chambers of another hydraulic screen. Because a mechanical valve is not relied upon to open and close the diverter inlet 88 so that chambers within a hydraulic screen can be activated, but rather rely on pressurized fluid conducted through the joint 44 to activate the chambers, the length of the hydraulic screens are shorter, the cost to manufacture is less, the screens are simpler to operate, and they are more reliable. As such, an operator could increase the number of screens in the series of coupled joints and hydraulic screens 22 and, therefore, increase production. It should be understood that joint 44 can include multiple inlets and multiple outlets.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, an apparatus for activating chambers of downhole hydraulic screens, the apparatus comprising: an outer sleeve having a first interface for coupling with a first hydraulic screen and a second interface for coupling with a second hydraulic screen; an inner sleeve; a flow path, defined as an annulus between an outer diameter of the inner sleeve and an inner diameter of the outer sleeve, comprising at least one fluid flow inlet and at least one fluid flow outlet; and the flow path is fluidly coupled to a chamber in each of the hydraulic screens;

Clause 2, the apparatus of clause 1, wherein the inner sleeve includes an interface for coupling with base pipe;

Clause 3, the apparatus of clause 2, wherein the inner sleeve comprises an internal diameter for communicating another fluid;

Clause 4, the apparatus of clause 1, further comprises a hydraulic seal formed where the inner sleeve couples with base pipe;

Clause 5, the apparatus of clause 1, further comprises a hydraulic seal formed at the first interface where the outer sleeve couples with the first hydraulic screen and a hydraulic seal formed at the second interface wherein the outer sleeve couples with the second hydraulic screen;

Clause 6, the apparatus of clause 1, wherein the inner sleeve further comprises an upper inner sleeve and a lower inner sleeve coupled together;

Clause 7, the apparatus of clause 6, further comprises a hydraulic seal formed between the upper inner sleeve and the lower inner sleeve;

Clause 8, a system comprising: a first hydraulic screen have at least one chamber; an outer sleeve having a first interface for coupling with the first hydraulic screen and a second interface for coupling with a second hydraulic screen; an inner sleeve; a flow path, defined as an annulus between an outer diameter of the inner sleeve and an inner diameter of the outer sleeve, comprising at least one fluid flow inlet and at least one fluid flow outlet; and the flow path is fluidly coupled to a chamber in each of the hydraulic screens;

Clause 9, the system of clause 8, wherein the inner sleeve includes a first and second interface for coupling with base pipe;

Clause 10, the system of clause 9, wherein the inner sleeve comprises an internal diameter for communicating another fluid;

Clause 11, the system of clause 9, further comprises a hydraulic seal formed where the inner sleeve couples with the base pipe;

Clause 12, the system of clause 8, further comprises a hydraulic seal formed at the first interface where the outer sleeve couples with the first hydraulic screen and a hydraulic seal formed at the second interface wherein the outer sleeve couples with the second hydraulic screen;

Clause 13, the system of clause 8, wherein the inner sleeve further comprises an upper inner sleeve and a lower inner sleeve coupled together;

Clause 14, the system of clause 8, further comprises a hydraulic seal formed between the upper inner sleeve and the lower inner sleeve;

Clause 15, a method for activating chambers of downhole hydraulic screens, the method comprising: coupling a plurality of outer sleeves and downhole hydraulic screens together; coupling a plurality of inner sleeves and base pipe together; running the base pipe into a subterranean well; wherein a flow path is defined between an outer diameter of each inner sleeve and an internal diameter of each outer sleeve; and pumping fluid into the base pipe, into the flow paths, and the chambers of the hydraulic screens;

Clause 16, the method of clause 15, further comprising: coupling an activation module to the base pipe; and pumping fluid into the base pipe, through the activation module, into the flow paths, and the chambers of the hydraulic screens;

Clause 17, the method of clause 16, wherein each inner sleeve comprises an internal diameter for communicating another fluid;

Clause 18, the method of clause 17, further comprises: releasing the fluid pumped into the base pipe; and pumping hydrocarbons from a reservoir in an earth formation through the hydraulic screen and into the internal diameter of each inner sleeve;

Clause 19, the method of clause 17, further comprises forming a hydraulic seal where each inner sleeve couples with base pipe; and Clause 20 the method of clause 15, further comprises forming a hydraulic seal where the outer seals couple with the downhole hydraulic screens.

What is claimed is:

1. An apparatus for activating chambers of downhole hydraulic screens, the apparatus comprising:

an outer sleeve having a first interface directly coupled to a bottom side of a first hydraulic screen and a second interface directly coupled to a top side of a second hydraulic screen, wherein the first hydraulic screen and the second hydraulic screen each have at least one chamber and the chambers of the first hydraulic screen and second hydraulic screen are configured to activate at a setting depth and via a pressurized fluid flow supplied from a wellsite surface, wherein the activation of the chambers of the hydraulic screens remove an annular gap in the wellbore;

an inner sleeve;

a flow path for conducting the pressurized fluid flow, the flow path defined as an annulus between an outer diameter of the inner sleeve and an inner diameter of the outer sleeve, comprising at least one fluid flow inlet and at least one fluid flow outlet; and the flow path fluidly coupled to then chambers in each of the hydraulic screens.

2. The apparatus of claim 1, wherein the inner sleeve includes an interface for coupling with a base pipe.

3. The apparatus of claim 2, wherein the inner sleeve comprises an internal diameter for communicating another fluid.

4. The apparatus of claim 1, further comprises a hydraulic seal formed where the inner sleeve is configured to couple with a base pipe.

5. The apparatus of claim 1, further comprises a hydraulic seal formed at the first interface when the outer sleeve is coupled with the first hydraulic screen and a hydraulic seal formed at the second interface when the outer sleeve is coupled with the second hydraulic screen.

6. The apparatus of claim 1, wherein the inner sleeve further comprises an upper inner sleeve and a lower inner sleeve coupled together.

7. The apparatus of claim 6, further comprises a hydraulic seal formed between the upper inner sleeve and the lower inner sleeve.

8. A system comprising:

a first hydraulic screen having at least one chamber;

a second hydraulic screen having at least one chamber;

an outer sleeve having a first interface directly coupled to a bottom side of the first hydraulic screen and a second interface directly coupled to a bottom side of a second hydraulic screen, wherein the chambers of the first hydraulic screen and the second hydraulic screen are configured to activate at a setting depth via a pressurized fluid flow from a wellsite surface, wherein the activation of the chambers of the hydraulic screens remove an annular gap in the wellbore;

an inner sleeve;

a flow path for conducting a pressurized fluid flow, the flow path defined as an annulus between an outer diameter of the inner sleeve and an inner diameter of the outer sleeve, comprising at least one fluid flow inlet and at least one fluid flow outlet; and the flow path fluidly coupled to a chamber in each of the hydraulic screens.

9. The system of claim 8, wherein the inner sleeve includes a first and second interface for coupling with a base pipe.

10. The system of claim 9, wherein the inner sleeve comprises an internal diameter for communicating another fluid.

11. The system of claim 9, further comprises a hydraulic seal formed when the inner sleeve is coupled with the base pipe.

12. The system of claim 8, further comprises a hydraulic seal formed at the first interface when the outer sleeve is coupled with the first hydraulic screen and a hydraulic seal formed at the second interface when the outer sleeve is coupled with the second hydraulic screen.

13. The system of claim 8, wherein the inner sleeve further comprises an upper inner sleeve and a lower inner sleeve coupled together.

14. The system of claim 8, further comprises a hydraulic seal formed between the upper inner sleeve and the lower inner sleeve.

15. A method for activating chambers of downhole hydraulic screens, the method comprising:

forming a base pipe assembly by:

coupling a plurality of outer sleeves and downhole hydraulic screens together, wherein a first end of a first outer sleeve of the plurality of the outer sleeves is coupled to a bottom side of a first hydraulic screen of the plurality of hydraulic screens, and wherein a second end of the first outer sleeve is coupled to a top side of a second hydraulic screen of the plurality of hydraulic screens;

and coupling a plurality of inner sleeves and base pipes together;

running the base pipe assembly into a subterranean well, wherein a flow path for conducting a pressurized fluid flow is defined between an outer diameter of each inner sleeve and an internal diameter of each outer sleeve;

after one or more of the hydraulic screens are positioned at a setting depth, supplying the pressurized fluid flow from a wellsite surface position;

then pumping the pressurized fluid into the base pipe assembly, into the flow paths, and the chambers of the hydraulic screens; and activating the chambers by the pressurized fluid flow, wherein the activation of the chambers of the hydraulic screens remove an annular gap in the wellbore.

16. The method of claim 15, further comprising:

coupling an activation module to the base pipes; and pumping fluid into the base pipes, through the activation module, into the flow paths, and the chambers of the hydraulic screens.

17. The method of claim 16, wherein each inner sleeve comprises an internal diameter for communicating another fluid.

18. The method of claim 17, further comprises:

releasing the fluid pumped into the base pipes; and pumping hydrocarbons from a reservoir in an earth formation through the hydraulic screen and into the internal diameter of each inner sleeve.

19. The method of claim 17, further comprises forming a hydraulic seal where each inner sleeve couples with the base pipes.

20. The method of claim 15, further comprises forming a hydraulic seal where the outer sleeve couples with the downhole hydraulic screens.

* * * * *